US007422045B2

(12) United States Patent
Polster

(10) Patent No.: US 7,422,045 B2
(45) Date of Patent: Sep. 9, 2008

(54) SEALING UNIT FOR APPLYING A PLASTIC FOIL TO A SUBSTRATE MATERIAL

(75) Inventor: Steffen Polster, Hochheim (DE)

(73) Assignee: Tetra Laval Holdings & Finance S.A., Pully (CH)

( * ) Notice: Subject to any disclaimer, the term of this patent is extended or adjusted under 35 U.S.C. 154(b) by 254 days.

(21) Appl. No.: 11/084,961

(22) Filed: Mar. 21, 2005

(65) Prior Publication Data

US 2005/0223676 A1 Oct. 13, 2005

(30) Foreign Application Priority Data

Apr. 8, 2004 (DE) ..... 10 2004 017 429

(51) Int. Cl.
*B32B 38/04* (2006.01)
*B65B 61/18* (2006.01)

(52) U.S. Cl. ..... 156/516; 156/522; 156/530; 156/581; 156/583.4; 53/133.3

(58) Field of Classification Search ..... 156/516, 156/209, 219, 270, 308.2, 583.4, 583.91; 83/15; 100/295
See application file for complete search history.

(56) References Cited

U.S. PATENT DOCUMENTS 2,467,572 A * 4/1949 Weisselberg ..... 156/61
2,822,029 A * 2/1958 Hoagland ..... 156/380.6
3,287,878 A 11/1966 Mobley ..... 53/133
3,505,152 A * 4/1970 Risch et al. ..... 156/514
4,662,978 A * 5/1987 Oki ..... 53/374.9
4,735,675 A * 4/1988 Metz ..... 156/583.4

FOREIGN PATENT DOCUMENTS

DE 2345476 B 9/1973
DE 3422679 A1 8/1985
DE 19503458 A1 8/1996

* cited by examiner

*Primary Examiner*—Melvin C Mayes
(74) *Attorney, Agent, or Firm*—Michael L. Dunn

(57) ABSTRACT

A sealing unit (8) for applying a plastic foil (7) to a planar substrate material (1) by means of heat and pressure using a sealing plate (11) with a heated active surface and a back plate (9) which is movable relative thereto. In accordance with the invention, sealed material from the sealing unit is provided to a die cutting unit (16) and preferably the sealing unit (8) is linked to the die cutting unit (16). The die cutting unit is provided with at least one die cutting knife (15) and a counter plate (21) for subsequently making die cuts (6) at selected locations in the planar substrate material (1) in the region of the applied plastic film (7). The sealing plate (11) of the sealing unit (8) has at least one set of raised (14) and depressed (13) regions on its active surface facing the back plate (9) and the location of the depressed regions (13) in the sealing plate (11) corresponds to the location of the die cutting knife (15), so that a cut (6) is made at the selected positions in the substrate material (1) where, because of the depressed regions (13) of the sealing plate (11), there is reduced and insignificant heating of the substrate material (1) and its laminations.

10 Claims, 4 Drawing Sheets

SEALING UNIT FOR APPLYING A PLASTIC FOIL TO A SUBSTRATE MATERIAL

BACKGROUND OF THE INVENTION

The invention relates to a sealing unit for applying a plastic foil to a planar substrate material by means of heat and pressure using a sealing plate with an active surface and a back plate which is movable relative thereto, in which the sealing unit is linked to a die cutting unit with a die cutting knife and a counter plate for subsequently making die cuts at selected locations in the planar substrate material in the region of the applied plastic film.

Sealing units of the type defined above are known in the packaging manufacturing art. An example is a filling machine for forming and filling a liquid packaging, which is continuously manufactured from a tube of packaging material, with filling and sealing. In this known example, the packaging material is a planar carrier material coated with plastic, the carrier material being paper or board. Opening devices for said known packaging consist of a hole through the planar substrate material, wherein the hole is closed on the inner side of the packaging with a plastic film and on the outer side with a tear tab. The tear tabs and plastic foil are heat sealed together so that on tearing the tear tab to open the packaging, the region inside the punched out hole of the inner plastic foil is torn out as well, forming a dispensing opening.

Previously, the tear tab was directly heat sealed to the outer plastic foil of the packaging over the hole. However, this suffers from the disadvantage that on tearing the tear tab, the outer plastic foil is not torn out cleanly with it, so that frayed naked board and plastic are sometimes visible along with the coated printed board, which produces a poor mouth feel when the packaging is placed in the mouth to take a drink.

For that reason, a further plastic film was heat sealed in the region of the hole which is subsequently made, with film around the hole for sealing with the outer plastic layer of the packaging. That plastic film or plastic foil, known as a prepatch, is an oriented polypropylene (OPP) foil, which is transparent and can readily be applied to the plastic layer on the carrier material on the underside of the packaging and binds well therewith, although externally it only develops a peelable weak bond with the tear tab, particularly if the tear tab is polyethylene (PE) coated aluminium. The planar substrate material is cut through together with the applied plastic or prepatch foil formed from OPP film. If the tear tab is subsequently removed to open the packaging, then advantageously no more frayed small regions of naked board, coated board and plastic swarf are seen. Furthermore, applying a prepatch plastic foil, plastic prepatch or cut out provides the consumer with a good mouth feel when liquid is drunk from the packaging.

When manufacturing such packaging with that type of planar substrate material, a sealing unit of the aforementioned type is used to seal the prepatches or plastic foil to the face of the substrate material which will subsequently form the outside, and subsequently the dispensing hole is formed by die cutting entirely through the substrate material, as described above. Thus, a die cutting unit is linked to the sealing unit, in which a suitably shaped die cutting knife is punched through the whole substrate material with the various plastic layers and foils.

With such a die cutting procedure, however, the prior art encounters a problem in that the substrate material in the sealing unit for applying the plastic foil is heated to the sealing temperature and shortly thereafter the location for the die cut is fed into the die cutting unit, so the die cutting knife has to punch through substrate material which is still almost at the sealing temperature. Unfortunately, the cut lines produced by the die cutting knife become frayed to a greater or lesser extent and occasionally plastic or fibres or swarf are left hanging. If poorly cut openings are sealed over with a tear tab, then occasionally, the seal is not complete and that pack cannot be used as it leaks. With a large secondary packaging, just two or three unsealed packs are enough to make the whole secondary packaging unusable and unsaleable. Thus, strenuous efforts have been made to avoid such swarf near the die cutting knife. Thus, for example, it has been shown that a very sharp new die cutting knife with a circular knife could produce clean cuts for a certain period. After 150 hours of operation, however, the die cutting knife was so blunt and worn that the swarf occurred again. More disadvantageously, detritus collects in the outlet of the machine, resulting in blockages. Frequently changing the die cutting tools has the additional disadvantage of intolerable cost increases for the manufacturer.

Thus, the aim of the invention is to improve a sealing unit of the type defined above so that the cut edges no longer have swarf of carrier material or plastic but are clean, with no projections.

BRIEF SUMMARY OF THE INVENTION

A sealing unit (8) for applying a plastic foil (7) to a planar substrate material (1) by means of heat and pressure using a sealing plate (11) with a heated active surface and a back plate (9) which is movable relative thereto. In accordance with the invention, sealed material from the sealing unit is provided to a die cutting unit (16) and preferably the sealing unit (8) is linked to the die cutting unit (16). The die cutting unit is provided with a die cutting knife (15) and a counter plate (21) for subsequently making die cuts (6) at selected locations in the planar substrate material (1) in the region of the applied plastic film (7). The sealing plate (11) of the sealing unit (8) has raised (14) and depressed (13) regions on its active surface facing the back plate (9) and the location of the depressed regions (13) in the sealing plate (11) corresponds to the location of the die cutting knife (15), so that cut (6) is made at the selected positions in the substrate material (1) where, because of the depressed regions (13) of the sealing plate (11), there is reduced and insignificant heating of the substrate material (1) and its laminations.

Usually the die cutting unit (16) is arranged downstream of the sealing unit (8) in the machine direction of the substrate material (1) at a predetermined distance therefrom and both units (8, 16) are controlled in a coordinated manner so that the selected positions in the substrate material (1) in the sealing unit (8) come into position over the depressed regions (13) and thereafter come into position under the die cutting knife or knives (15) in the die cutting unit (16). The planar substrate material web (1) is usually moved by drive means in an intermittent manner from the sealing unit (8) into the die cutting unit (16).

In general, the depressed regions (13) in the active surface of the sealing plate (11) form a pattern which is an image of the pattern of the die cutting knife or knives (15) of the die cutting unit (16) so that both patterns are congruent. The depressed region (13) of the sealing plate (11) is wider than the die cutting knife (15) of the punch and surrounds the cut (6) of the punch pattern on all sides. Usually the sealing plate (11) is formed from metal which is routed on its active surface to form the depressed regions (13), and the active surface is preferably coated with a scratch proof plastic material such as polytetrafluoroethylene (TEFLON).

In a preferred embodiment, the sealing unit (8) forms part of an opening assembly for a filling machine for liquid packaging and the substrate material (1) is a carrier material web (22) provided with a ply of plastic layers (23, 24, 26) with score lines (3) for the production of a packaging with a tear tab (27), and the pattern for the die cutting knife (15) is a circle.

DETAILED DESCRIPTION OF THE INVENTION

Figure 1:
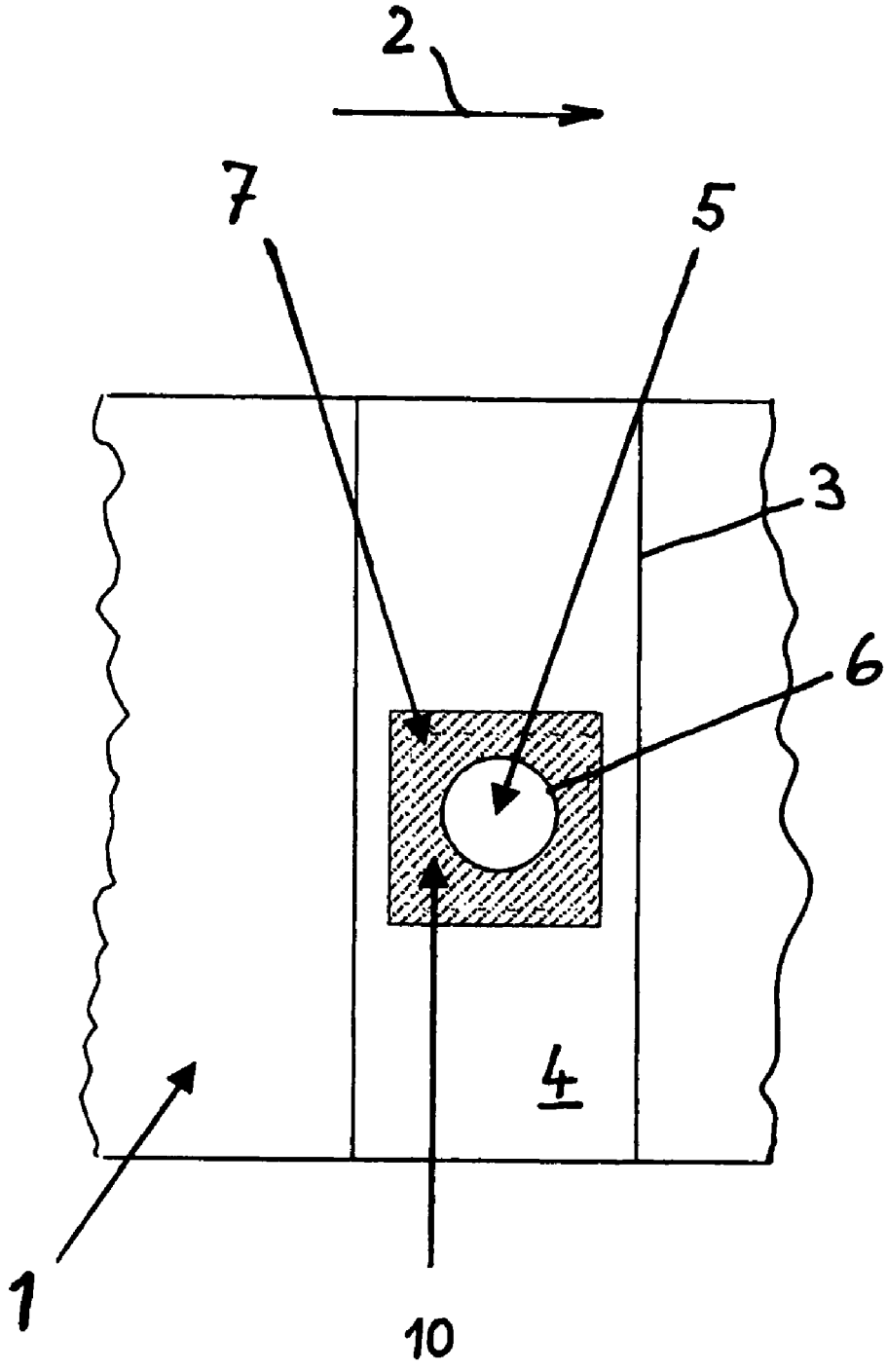
FIG. 1 shows a top view of part of a web-like substrate material in the form of a board web laminated with plastic after applying an outer plastic prepatch in a conventional manner, with subsequent die cutting of a hole.

The aims of the invention are achieved by utilization of a sealing unit having a sealing plate that has raised and depressed regions on its active surface facing a back plate and the location of the depressed regions in the sealing plate corresponds to the location where a die cutting knife cuts a hole, so that the cut is made at the selected positions in the substrate material where, because of the depressed regions of the sealing plate, there is almost no heating of the substrate material and its laminations. To start with, the special sealing plate with the raised and depressed regions in its active surface seals the plastic foil over a large surface area of the substrate material, in which die cuts will subsequently be made around it in the die cutting unit. These die cuts are of particular good quality, i.e. sharp cuts with no swarf, since the die cutting knife is punched through cooler regions of the substrate material. Secondly, since this advantageous embodiment of the sealing plate is provided with depressed regions at selected locations which are subsequently cut in the die cutting unit, then the die cutting knife can be inserted into regions of the substrate material which were not brought to the higher temperature, as necessarily occurs in other (raised) regions, to apply the plastic foil. Thus, the plastic foil can be applied to the substrate material with sufficient adhesion, and (because of the depressed regions in the sealing plate) cooler regions are produced at selected positions because those depressed regions of the sealing plate mean that there is almost no heating. Surprisingly, it has been shown that die cuts formed in this manner are sharp and free of swarf even if the die cutting knife has been operating for a long time. Thus, surprisingly, this particular sealing plate with the depressed regions can produce cuts without projections, even with laminated substrate materials.

In an advantageous further embodiment of the invention, the die cutting unit is arranged downstream of the sealing unit in the machine direction of the substrate material at a predetermined distance therefrom and both units are controlled in a coordinated manner so that the selected positions in the substrate material in the sealing unit come into position over the depressed regions and thereafter come into position beneath the die cutting knife of knives in the die cutting unit. The sealing unit and the die cutting unit can be two separate devices which are arranged one behind the other as defined above, so that the substrate material, whether in sheets or webs, feeds initially into the sealing unit and then into the die cutting unit. The time for the substrate material to feed from the sealing unit into the die cutting unit is between one second and three minutes, preferably about two seconds. It is essential that the substrate material in the sealing unit is heated to the sealing temperature, about 160° C., and that after that time the substrate material, if processed in the die cutting unit, is still at a relatively high temperature, so the plastic layer or layers or foils or films are still relatively soft. Thus, the swarf described above would be formed if the sealing plate of the invention were not used.

When the substrate material in the sealing unit is described as being positioned over the depressed regions and then beneath the die cutting knife in the die cutting unit, then the terms "over" and "under" refer to the position for action (with corresponding effect) rather than an orientation in space for the depressed regions and for the die cutting knife on the substrate material. In a preferred embodiment, the substrate material is orientated over the depressed regions, i.e. the sealing plate approaches the substrate material from below and presses it upwards against the back plate. In this or other preferred embodiments, in the die cutting unit too, the substrate material is positioned under the die cutting knife or knives, i.e., the die cutting knife moves from above the substrate material downwardly, passing a short distance through it, to complete die cutting. In other machines, however, other directions of movement of the sealing plate and the die cutting knife may be appropriate.

If the sealing unit and the die cutting unit are separate devices, both units must be driven in a coordinated manner so that the substrate material is protected from being heated at the selected positions and so that the die cutting knife or knives operates only in those regions that remain cool, since punching a die cutting knife into a substrate material at a high temperature should be avoided. Thus, coordinated control of the units is primarily positional in nature, so that the position of the die cutting knife is properly directed to the regions of the substrate material that remain cool. The coordinated control is only time-orientated in a secondary capacity. Preferred machines have both units in one production line in which a web-like planar substrate material is advanced in an intermittent manner, first in the sealing unit and thereafter in the die cutting unit. Since simply because of space constraints, both units are relatively close to each other, it is also clear that the time between residence in the sealing unit to residence in the die cutting unit is too brief to allow the temperature of the substrate material heated in the sealing unit to cool down much from one unit to the other.

The invention also envisages that the depressed regions in the active surface of the sealing plate form a pattern which is an image of the pattern of the die cutting knife or knives of the die cutting unit so that both patterns are congruent. The sealing plate operates like a stencil which produces a pattern of temperatures rather like a thermal image on the substrate material. This pattern of the depressed regions of the sealing plate essentially corresponds to the position of the die cutting knife or knives—with one exception, which will be explained below. This correspondence and congruence of the patterns in both units is ensured so that the die cutting knife—in any form, location or arrangement—only cuts the substrate material in the regions which remain cool. Thus, advantageously, swarf is avoided, also avoiding the aforementioned blockages in the die cutting unit of the machine.

The exception mentioned above is that a die cutting knife and its effect (the cut) are much narrower than the channel-like depressions or recesses in the sealing plate. The invention is thus further characterized in that the depressed region of the sealing plate is broader than the die cutting knife of the die cutter, and surrounds the cut of the cutting pattern. This condition ensures that the die cutting knife or the die cutting tool only cuts in regions of the substrate material and swarf is never a risk.

If in a further advantageous embodiment of the invention the sealing plate is formed from metal and its active surface is routed to form the depressed region, then advantageously the active surface is covered with a scratch proof plastic material, and so the sealing unit and in particular the sealing plate can be simply, economically and effectively produced. Aluminium is particularly suitable for use as the sealing plate. The depressed regions thus have a particular pattern of channels; obviously, the raised regions are formed by the remaining material (for example aluminium).

To seal properly, the active surface of the sealing plate is advantageously coated with said scratch proof plastic material, advantageously Teflon. After supplying heat and pressure by means of the sealing plate, the active surface is then more easily released from the plastic foil, i.e. the cut out or the applied outer prepatches.

The substrate material can be any at least partially plastic coated carrier material, for example board or paper. The problem with swarf or frayed cuts always occurs if a plastic foil on a carrier material is cut at a temperature close to the softening temperature of the plastic. The substrate material can be in sheet or web format.

Particularly preferably, the planar substrate material is moved by drive means from the sealing unit to the die cutting unit in an intermittent manner. Said device to which both units are connected is particularly preferably used as an opening assembly for a filling machine, in which said opening assembly is provided upstream of the filling machine as defined by the forward direction of the web-like substrate material.

Thus, for example, it is advantageous if the sealing unit belongs to an opening assembly for a filling machine for liquid packaging and the substrate material is a carrier material web having a plurality of plastic laminations with score lines for the production of a packaging with a tear tab and the pattern for the die cutting knife is a circle. Liquid packaging which is somewhat cuboid in form is known. Producing such liquid packaging from plastic coated board as the substrate material is also known, wherein a board web, which is moved intermittently through the filling machine, finally becomes the filled and sealed packaging. This packaging also has a dispensing opening which consists of a hole in the upper edge of the packaging, which is closed by a tear tab from the top, subsequently the outside of the packaging, and preferably is sealed on the inside by a further plastic foil (edge protection of the cut lines).

An upstream paper machine produces the web with the packaging cut lines, and this web of packaging material has said board as the carrier, which is preferably laminated with a plurality of layers. This includes, for example, an aluminium layer and a polyethylene layer laid on top of it. Before sealing on the tear tab on the outside and the plastic foil (polyethylene) on the inside of the subsequent pack over the hole, and thus before these two last laminates are formed, the carrier material web provided with the various laminates is punched to form the hole, and for a circular hole, the pattern for the die cutting knife is also a circle. The laminated carrier material web is also provided with various score lines which are known per se, in order to fill the tube with liquid then seal it and form the packaging by folding. In this form and fill machine, the aforementioned problem of a lack of seal has existed for many years, without a suitable tooling solution to be offered. Only the invention, with its special sealing plate and the depressed regions, with which the cutting regions can remain cool, has completely solved the problem. Now, liquid packaging can be produced at a high throughput with high performance filling machines and can be collected into secondary packages without any primary packages leaking.

Further details, features and applications of the invention will become apparent from the following description of a preferred embodiment made with reference to the accompanying drawings.

FIG. 1 shows part of a web-like carrier material or substrate material 1. The web of said material 1 is advanced from left to right in FIGS. 1 to 4 in an intermittent manner. Reference numeral 3 shows two score lines which run transverse to the forward direction 2 of the substrate material and show a portion of the blank for the subsequent packaging. In this diagram, the two score lines 3 form the upper wall 4 of the packaging, in which the opening device and thereby also the hole 5 are arranged. The dispensing hole 5 is produced by punching the die cutting knife 6 into the substrate material. In FIG. 5, the die cut 6 is shown as two dotted lines which pass through the laminated substrate material but not through the two outer layers.

The cut 6 passes through the outer applied prepatch of the plastic foil 7. The outer side of the subsequent drinks packaging in this specific embodiment is considered in the Figures to be above the substrate material 1 as observed by the observer and is beneath the substrate material 1 in cross sectional FIG. 5; the inside is thus the top in FIGS. 2, 3 and 5 and in the top view of FIGS. 1 and 2, behind the broken parts. In a sealing unit shown only in FIG. 2 with the general reference numeral 8, the prepatch shaped plastic foil 7 is sealed prior to cutting the hole 5, in conventional manner in FIG. 1, wherein a sealing plate (not shown) with an even flat surface must be imagined, as must be the back plate 9 of the sealing unit 8 in FIG. 2. This means that the whole of the hatched region of the plastic foil 7 in FIG. 1 is heated to the softening temperature on sealing and the die cut 6 (not shown in FIG. 1) is frayed and has thread like projections. Thus, a conventionally produced hole 5 can often result in a lack of seal in the region of the dispensing opening. If the unhatched region of the hole 5 in FIG. 1 is ignored, the seal surface 10 is square and runs practically completely beneath the whole plastic foil 7.

Figure 2:
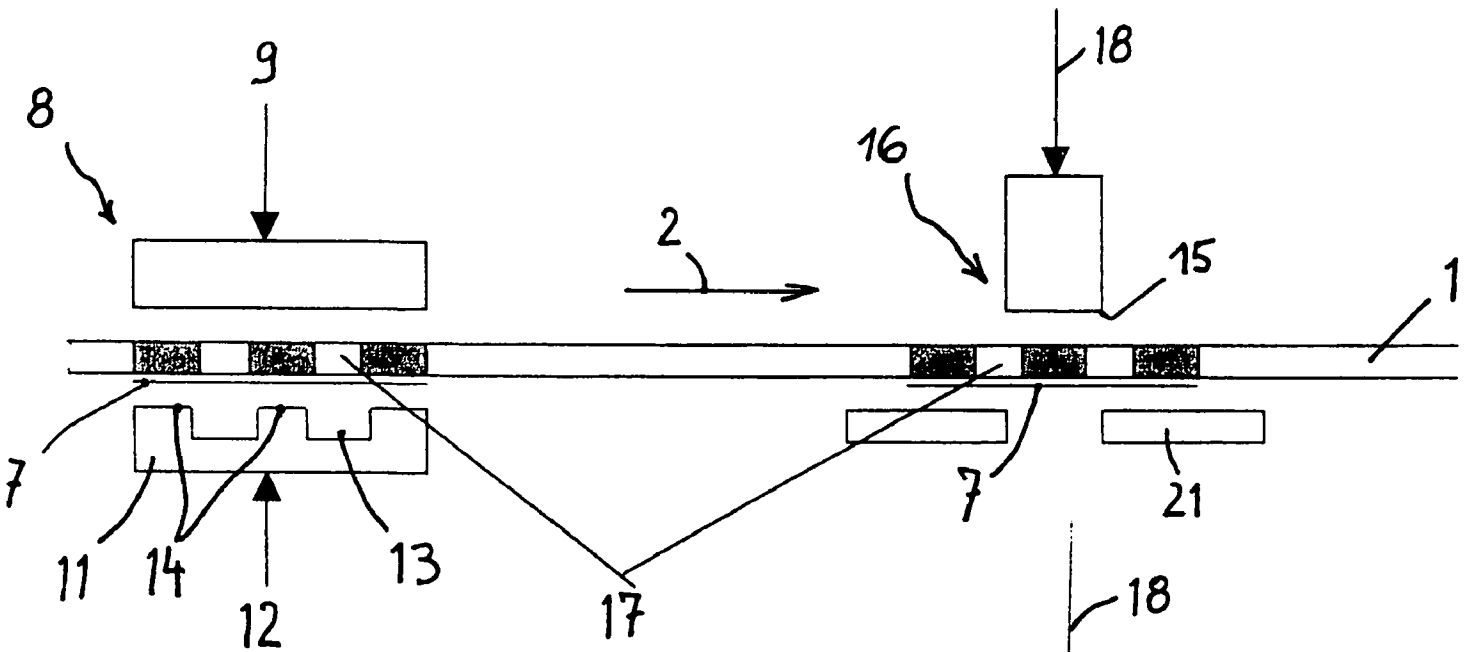
FIG. 2 shows, in cross section, a sealing unit on the left and a die cutting unit on the right prior to die cutting, in an embodiment of the invention.

To overcome the concomitant disadvantages, the sealing plate 11 shown in FIG. 2 beneath the substrate material 1, which is driven upwards, mounted and fixed from below as shown by arrow 12, has channel-like depressed regions 13 and neighbouring raised regions 14. If it is assumed that the raised regions 14 are formed during the routing procedure by leaving them out, then when producing the sealing plate, the depressed regions 13 can be routed to the desired width to form a pattern. The width of the depressed regions 13 is 2 to 20 mm, preferably 5 to 15 mm, and the depression has a height difference of 0.5 to 4 mm, preferably 1.5 to 3 mm and highly preferably 2 mm. The plastic (e.g. Teflon) coating, not shown in FIG. 2, is then applied so that it is both on the raised and on the depressed regions 13, 14. In the case of a dispensing hole 5, the line of the cut 6 is substantially circular, so the pattern is a circle. This circular pattern is followed not only by the die cutting knife 15 and thus also by the line of the cut 6, but also by the depressed regions 13. The web substrate material 1 extends both through the sealing unit 8 of FIG. 2 and through the die cutting unit 16 and is intermittently advanced in direction 2. The plastic foil 7 in the form of the outer fleck is shown in FIG. 2 as a line in the region of the sealing unit 8 below the material 1, as the plastic foil 7 has to be sealed to the outside of the material 1. If the movable back plate 9 is pressed onto the sealing plate 11 with the substrate material 1 with plastic foil 7 therebetween, the greyed regions in material 1 are heated as these are opposite to the raised regions 14 of the sealing plate 11. In between are the cool regions 17 in the web of substrate material 1.

Figure 4:
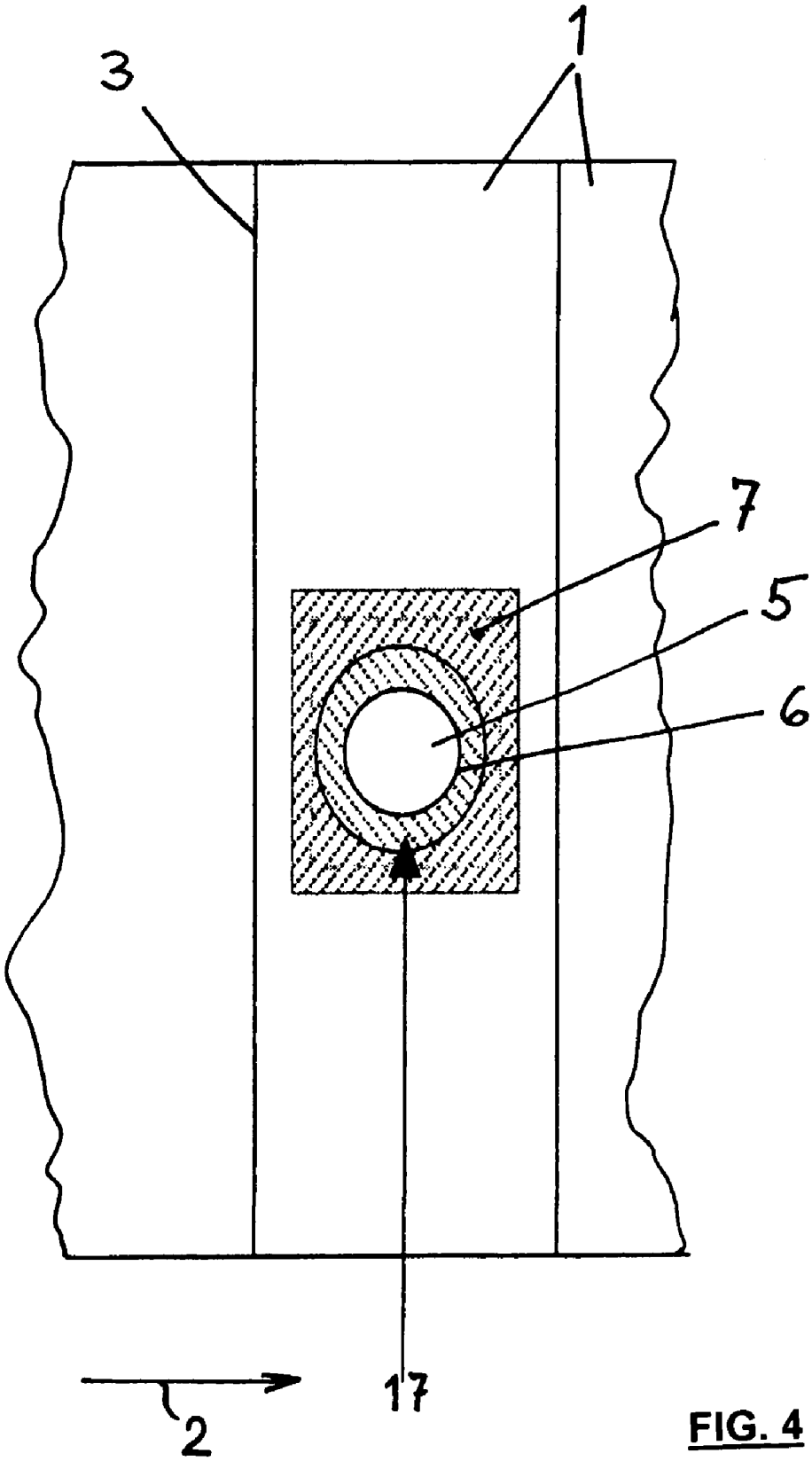
FIG. 4 shows a similar view to FIG. 1, however in this case with the product manufactured in accordance with the invention, in which the outer plastic prepatch applied to the top of the coated board web has a seal-free ring-shaped region around the hole stamped out in the centre.
Figure 5:
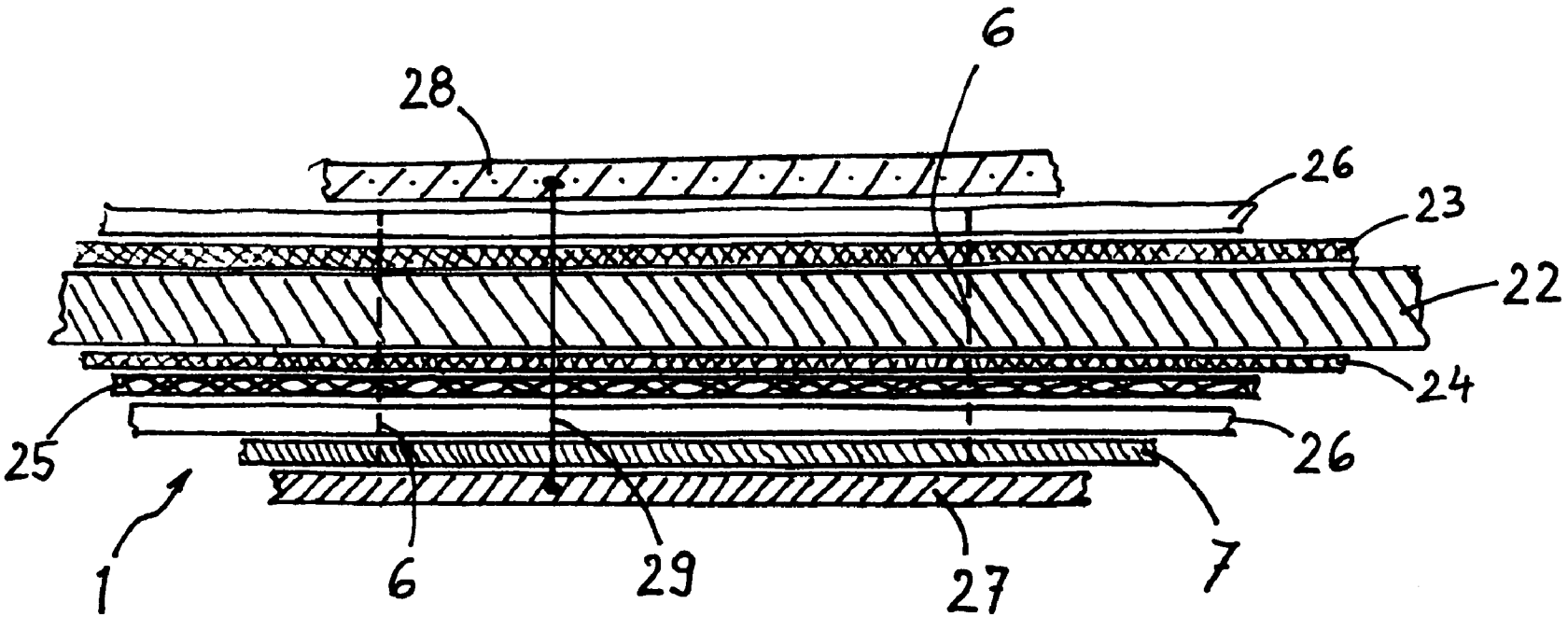
FIG. 5 shows a cross sectional view of a preferred substrate material with the die cut lines shown as dotted lines with solid lines arranged diagrammatically therebetween to illustrate that the outer laminates are sealed together.

If we now consider FIG. 4, we can see a near circular annular region hatched from upper left to lower right, which constitutes the cool region 17. It should be ensured that prior to cutting the hole 5, this cool region 17 also extends beyond the cut line 6 and further inwardly, as the cut 6 must be completely surrounded on both sides by cool regions 17.

This is clearly seen in FIG. 2; the cool regions 17 in the web substrate material 1 are almost centrally beneath the die cutting knife 15. If the die cutting knife 15, formed in this embodiment as a punch, is moved in the direction of the arrow 18 downwardly through the substrate material 1, then not only is the cut produced, but the hot seal region 19 of the punched circular disc 20 with the plastic foil attached thereunder is seen, and laterally outwardly next to the two cuts 6 are the cool regions 17 in the carrier material 1, shown in FIG. 3 in white. On both sides of the die cutting knife, then, there are portions of the cold region 17, with the result that the cut 6 passes completely through cool material. This produces a clean, unfrayed and swarf-free cut 6 in the desired pattern, that of a circle in the embodiment shown here.

Figure 3:
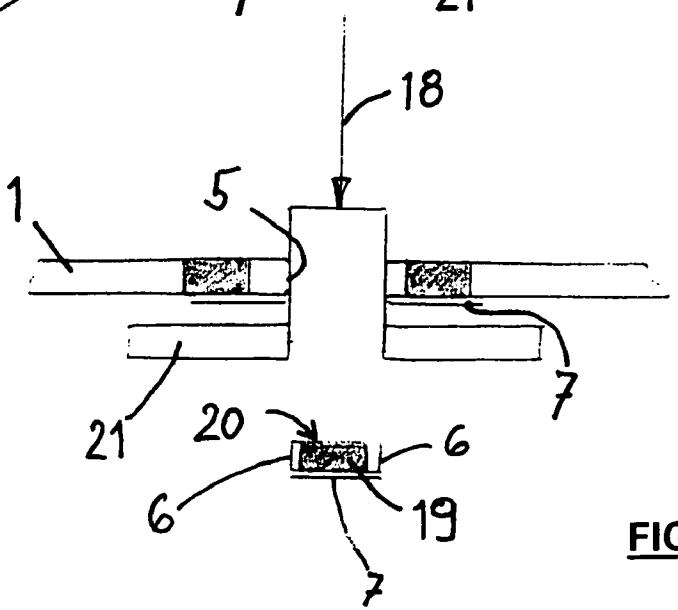
FIG. 3 shows, as the same cross section as in FIG. 2, the die cutting unit shortly after cutting the hole.

In FIG. 3, the punch with the die cutting knife 15 is then raised in the direction opposite to the arrow 18 and it returns to the position shown in the top view of FIG. 4.

It is clear that the counter plate 21 of the die cutting unit 16 delimits the circular hole in selected positions, to produce a scissor action with the die cutting knife 15 to punch out the hole 5.

The separation in the advance direction 2 of the die cutting unit 16 from the sealing unit 8 is shown in FIG. 2 by the vertical separation of arrows 9 and 18 which each approximately lie on the centre line of the unit.

FIG. 5 diagrammatically shows a cutaway section through the substrate material generally designated as 1. The carrier material web 22 in this embodiment is a board web and is shown approximately centrally as a relatively thick web, hatched from top left to bottom right. Underneath this central web 22 are the outer layers and the inner layers of the subsequent packaging are on the top. An inner aluminium layer 23 and an outer aluminized layer 24 are cross-hatched. The outer printed layer 25 follows, hatched in the form of two offset sinusoidal lines. It is known to provide the outsides of packaging with printing, and if this is applied to an aluminized layer 24 in the form of the printed layer 25, a gloss effect can be achieved, as in this embodiment. For protection, a plastic layer is applied outwardly of the printed layer 25 and inwardly of the aluminium layer 23, preferably of polyethylene (PE). This is designated as 26 on each side and is not hatched.

The substrate material 1 is a web up to this polyethylene (PE) layer 26. Subsequently, the prepatch-shaped plastic foil 7 is attached in the sealing unit 8 with the help of the special sealing plate 14. The sealed condition is shown in FIG. 5, and this plastic foil 7 is shown by narrow short hatching from top left to bottom right.

In this condition, i.e. substrate material 1 plus plastic foil 7, die cutting is carried out, so that the cut 6 is produced, shown as the dashed line. Said substrate material with the plastic prepatch 7 now has a hole which can later be used as the dispensing hole 5. Firstly, though, the packaging must be sealed. Thus, from the outside, a tear tab 27 is applied, which is shown in FIG. 5 by the hatching from bottom left to top right. Said tear tab 27 is polyethylene coated aluminium, which is known per se. On the opposite inward side, i.e. on the top in FIG. 5, a further polyethylene layer is sealed over the hole and heat sealed with the tear tab 27. The latter bond by heat sealing between the inner polyethylene layer 28 and the outer tear tab 27 is shown in FIG. 5 as a solid line 29 with two end bars. If the consumer tears the tear tab 27 from the filled drinks packaging, he will also tear the inner polyethylene layer 28 in the region of the dispensing hole 5, to gain access to the contents of the packaging and to be able to use the dispensing hole 5. The inner polyethylene layer 28 is distinguished by diagonal hatching from bottom left to top right with interspersed dots.

What is claimed is:

1. A sealing and cutting unit for applying a plastic foil to a planar substrate material to form laminated material by means of heat and pressure comprising: a sealing unit, a die cutting unit and a drive for moving laminated material from the sealing unit to the die cutting unit, said sealing unit comprising a sealing plate with a heated active surface and a back plate which is movable relative thereto said die cutting unit comprising a die cutter with at least one die cutting knife, and a counter plate for making die cuts at selected locations in the planar substrate material in the region of the applied plastic foil, wherein the sealing plate of the sealing unit has at least one set of raised and depressed regions on a surface facing a portion on the back plate that forms an area of reduced heating of the plastic foil over the depressed regions and the drive for moving the laminated material provides the laminated material to the die cutting unit so the area of reduced heating corresponds to the location of the die cutting knife during cutting, so that cuts are made only in the area of reduced heating.

2. A sealing and cutting unit according to claim 1 wherein the sealing and cutting unit comprises the sealing unit connected to the die cutting unit.

3. A sealing and cutting unit according to claim 2, wherein the die cutting unit is arranged downstream of the sealing unit in a machine direction of the substrate material at a predetermined distance therefrom and the sealing unit and die cutting units are controlled in a coordinated manner so that a selected position in the substrate material in the sealing unit comes into position over a depressed region and thereafter comes into a corresponding position under the die cutting knife in the die cutting unit.

4. A sealing and cutting unit according to claim 3 wherein a plurality of depressed regions in the active surface of the sealing plate form a pattern which is an image of the pattern of a plurality of die cutting knives of the die cutting unit so that both patterns are congruent.

5. A sealing and cutting unit according to claim 3 wherein the planar substrate material is moved by drive means in an intermittent manner from the sealing unit into the die cutting unit.

6. A sealing and cutting unit according to claim 2 wherein the planar substrate material is moved by drive means in an intermittent manner from the sealing unit into the die cutting unit.

7. A sealing and cutting unit according to claim 1 wherein the depressed region of the sealing plate is wider than the die cutting knife of the die cutting unit such that the area of reduced heating surrounds the cut of the die cutting unit on all sides.

8. A sealing and cutting unit according to claim 1 wherein the sealing plate is formed from metal which is routed on its active surface to form the depressed regions and wherein the active surface is coated with a scratch proof plastic material.

9. A sealing and cutting unit according to claim 1 wherein it forms part of an opening forming assembly for a filling machine for liquid packaging and the substrate material is a carrier material web provided with a ply of plastic layers with score lines for the production of a packaging with a tear tab over an opening, and the pattern for the die cutting knife is a circle.

10. A sealing and cutting unit according to claim 1 wherein the portion on the back plate is a flat portion.

* * * * *